US005853314A

United States Patent [19]

Bora

[11] Patent Number: 5,853,314

[45] Date of Patent: Dec. 29, 1998

[54] TOY BUILDING BLOCK

[76] Inventor: Sunil K. Bora, 31950 Concord Dr. #19A, Madison Heights, Mich. 48071

[21] Appl. No.: 802,537

[22] Filed: Feb. 18, 1997

[51] Int. Cl.[6] ..... A63H 33/08

[52] U.S. Cl. ..... 446/120; 446/125; 446/102; 446/124

[58] Field of Search ..... 446/102, 104, 446/114, 115, 116, 120, 124, 125, 127, 128

[56] References Cited

U.S. PATENT DOCUMENTS

| | | | |
|---|---|---|---|
| 2,786,301 | 3/1957 | Torricelli | 446/124 |
| 3,420,275 | 1/1969 | Glen et al. | 446/124 |
| 3,422,588 | 1/1969 | Stewart, Jr. | 52/285 |
| 4,306,373 | 12/1981 | Chatani et al. | 446/124 |
| 4,698,023 | 10/1987 | Marino | 434/259 |
| 4,738,648 | 4/1988 | Berndt | 446/120 |
| 4,758,196 | 7/1988 | Wang | 446/104 |
| 4,822,315 | 4/1989 | Ben-Gal et al. | 446/102 |
| 4,902,259 | 2/1990 | Ziegler | 446/117 |
| 4,964,833 | 10/1990 | Suzuki | 446/118 |
| 4,964,834 | 10/1990 | Myller | 446/118 |
| 5,094,643 | 3/1992 | Bolli et al. | 446/121 |
| 5,154,656 | 10/1992 | Milstein | 446/120 |
| 5,180,323 | 1/1993 | Justice | 446/120 |
| 5,215,490 | 6/1993 | Szoradi | 446/115 |

FOREIGN PATENT DOCUMENTS

| | | | |
|---|---|---|---|
| 2229052 | 6/1972 | Germany | 446/128 |

*Primary Examiner*—Robert A. Hafer
*Assistant Examiner*—Laura Fossum
*Attorney, Agent, or Firm*—Young & Basile, P.C.

[57] ABSTRACT

A toy building block in the form of a rectangular prism is interlockable with similar blocks located on any of its sides. The block also has mating female and male features which permit connection between two blocks in either of two mating relationships, the first relationship permitting swivelling movement between the blocks and the second relationship inhibiting swivelling movement.

12 Claims, 5 Drawing Sheets

FIG-10A
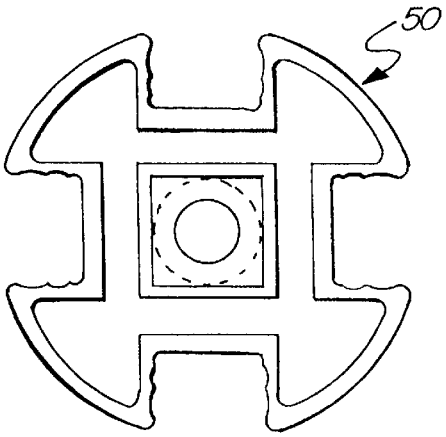
FIG-10B
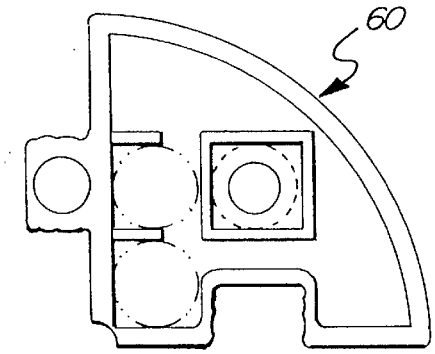
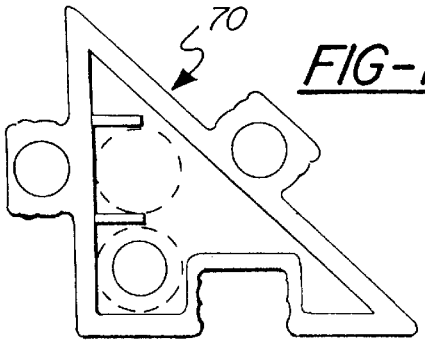
FIG-10C
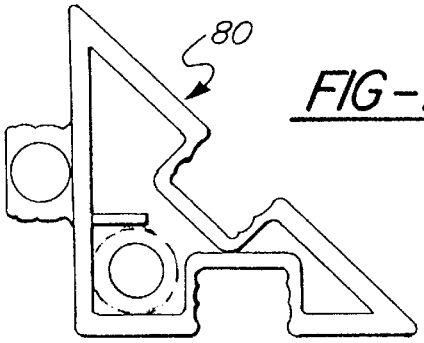
FIG-10D
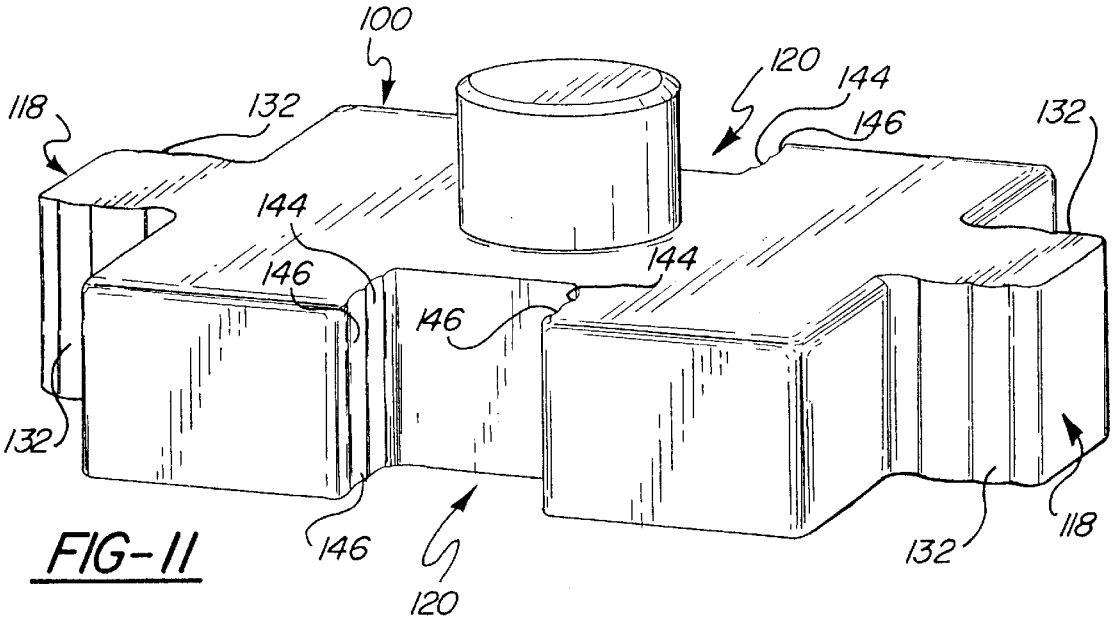
FIG-11

TOY BUILDING BLOCK

FIELD OF THE INVENTION

This invention relates to toy construction or building blocks of the type having interlocking male and female features allowing the blocks to be assembled with one another to create structures.

BACKGROUND OF THE INVENTION

This application claims the benefit of U.S. Provisional patent application Ser. No. 60/019,971, filed Jun. 17, 1996.

A large number of different toy building blocks exist in the prior art. Such blocks are known to have interlockable male and female features allowing the blocks to be removably connected to one another in one or more relative configurations. Perhaps the most well known brand of such a toy building block is the LEGO®, wherein generally square or rectangular blocks are built up in layers to form a desired shape or structure. Each LEGO® block has one or more studs protruding from an upper surface and receptacles formed on an opposite lower surface sized to snugly receive the studs of mating blocks. This block geometry permits interlocking engagement between blocks in adjacent layers, but does not provide for engagement between blocks within each layer. Further, the standard LEGO® block does not permit relative hinging or swivelling movement between two connected blocks, so that a specialized hinge block is required if such movement is desired.

SUMMARY OF THE INVENTION

It is an objective of the present invention to provide a toy building block that is removably interlockable with similar blocks to construct structures of a variety of different shapes.

It is a further objective of the present invention to provide a building block that is interlockable with similar blocks contacting at least two non-parallel sides of the block.

It is a yet another objective of the present invention to provide a building block set composed of a minimum number of differently shaped blocks while being usable to construct structures having a wide range of different geometries.

It is a still further objective of the present invention to provide a building block which may be interlocked with similar blocks in a manner to allow swivelling and rotating movement out of the plane of connection between the interlocked blocks.

It is a still further objective of the present invention to provide a building block engageable with a similar block in either of two manners, the first manner permitting swivelling movement between the blocks and the second inhibiting swivelling movement.

In general, these objectives are achieved by a building block comprising a body having a top face formed with a male feature thereon, a bottom face substantially parallel to the top face having a female feature formed thereon and matable with male features of similarly shaped blocks to achieve interlocking assembly of the block and the similarly shaped blocks in a first building direction perpendicular to the top face, first and second sides oriented substantially normal to the top face, a side male feature on the first side, and a side female feature on the second side matable with side male features of the similarly shaped blocks to achieve interlocking assembly of the block and the similarly shaped blocks in a second building direction substantially perpendicular to the first building direction. The invention block may thereby be interlocked with similar blocks extending in both the first building direction and the second building direction, thereby giving greater flexibility in the geometry of structures built from the blocks.

According to another aspect of the invention, the side male and side female features have respective first and second interlocking means engageable with one another in a first mating relationship and in a second mating relationship. In the first mating relationship, the male feature is inserted substantially fully into the female feature and the adjacent faces of the connected blocks are parallel and closely proximate one another. This first connection inhibits swivelling movement between the connected blocks in a plane orthogonal to the adjacent faces, so that the blocks are relatively rigidly connected. In the second mating relationship, the male feature is inserted less than fully into the female feature and the adjacent faces of the connected blocks are separated from one another by a distance sufficient to permit swivelling movement. This two-position interlocking feature allows a single type of block to be connected with its neighbors in either a swivelling or a non-swivelling manner depending upon the desires of the person utilizing the blocks. A specialized swivelling block is not required, since all blocks have the ability to be swivellingly connected to their neighbors.

In a preferred embodiment of the invention building block depicted herein, the body of the block is in the form of a prism having six rectangular faces and has a cylindrical peg projecting from an upper face and each of two opposite end faces. The remaining two side faces have receptacles formed therein, the receptacles taking the form of slots extending from the top to the bottom surface. The lower face is formed with a plurality of receptacles. The top peg and end pegs are matable with any of the receptacles of a similar block to allow interlocking assembly of the blocks in a multitude of directions and orientations. Since each block may be interlocked with adjacent blocks contacting any of its six faces, the number of possible directions and orientations in which the blocks may be assembled is increased.

Also in the preferred embodiment, each end peg has a raised bead extending around its circumference and each side receptacle has a pair of inner grooves and a pair of outer grooves. The end peg may be inserted into the receptacle of a similar block so that the bead engages the inner grooves and the two blocks are thus locked relatively rigidly together. Alternatively, the end peg may inserted so that the bead engages the outer groove and the two blocks may be swiveled with respect to one another. In either of these two types of connections, the blocks are rotatable with respect to one another about the axis of the peg. This two-position connection feature allows a single type of block to be used when rigid block-to-block connection is required as well as when swivelling connection is required.

In another preferred embodiment, the end pegs are rectangular in cross section and have raised beads extending along opposite faces thereof. The rectangular end pegs are engagable with the grooved side receptacles of a similar block in the same two-position manner as with the cylindrical peg embodiment.

BRIEF DESCRIPTION OF THE DRAWINGS

FIG. 10 is a bottom view of several examples of non-rectangular building blocks according to the present invention;

FIG. 11 is a perspective view of an alternative embodiment of a building block according to the present invention;

DETAILED DESCRIPTION OF THE PREFERRED EMBODIMENT

Figure 1:
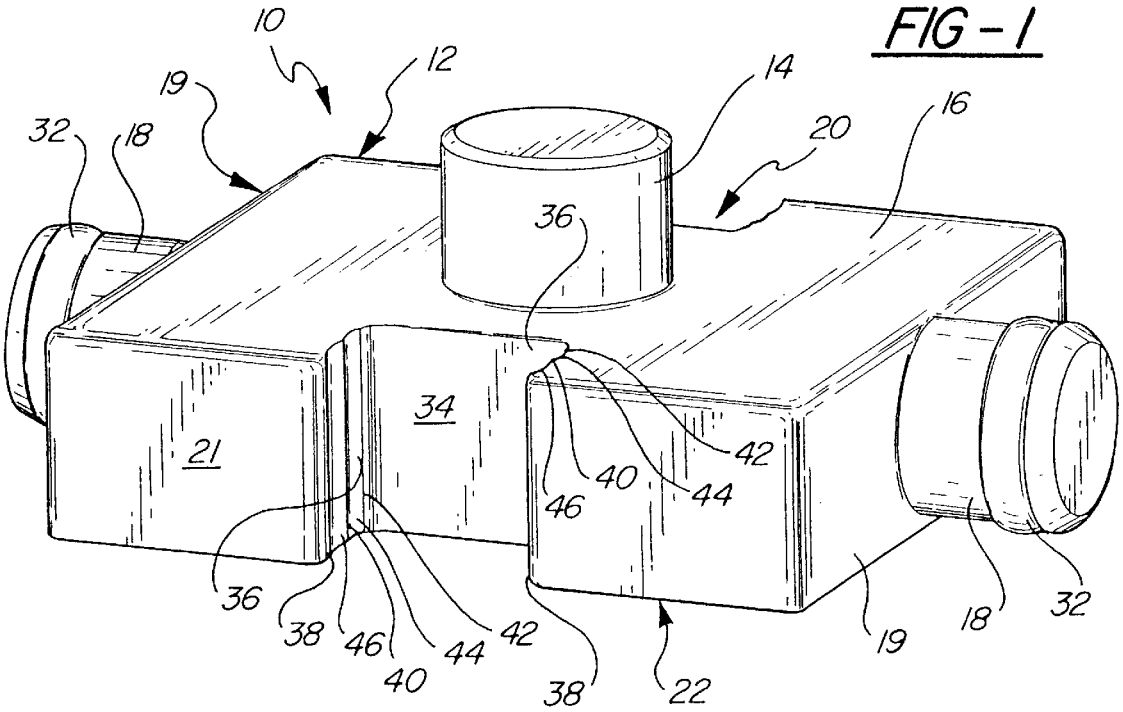
FIG. 1 is a perspective view of a building block according to the present invention.
Figure 2:
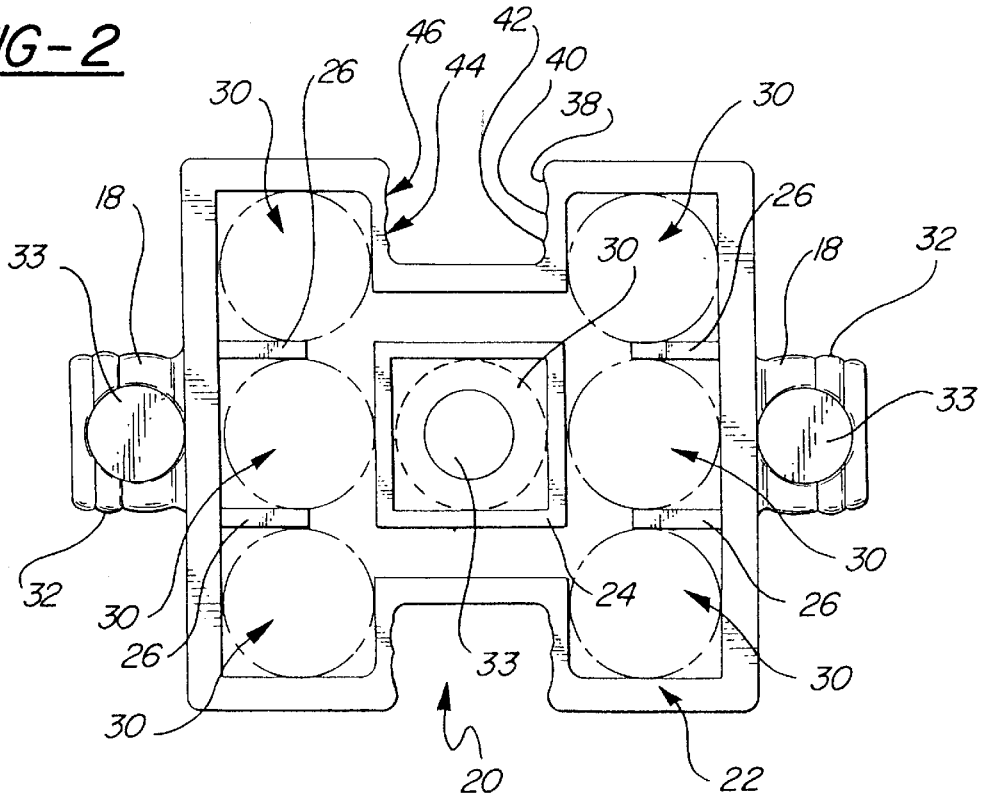
FIG. 2 is a bottom view of the invention building block.

Referring to FIGS. 1 and 2, a block 10 according to the present invention is seen to comprise a body 12 in the form of a rectangular prism having a top face 16, a parallel bottom face 22, and four lateral faces comprising two end faces 19 and two side faces 21. A top peg 14 is located substantially centrally on and projects upwardly from top face 16, and a pair of end pegs 18 project perpendicularly from end faces 19.

As best seen in FIG. 2, body 12 is a substantially hollow structure having an open bottom face 22 defined by the walls which form the ends and sides of the body. A square box 24 extends downwardly from the center of the lower surface of top face 16 and four ribs 26 extend into the hollow interior of body 12 from end faces 19. Box 24 and ribs 26 combine with the walls forming the sides and ends of body 12 to define seven substantially square bottom receptacles 30 recessed into bottom face 22.

End pegs 18 are generally cylindrical and each has a narrow, circumferentially extending protrusion or bead 32 projecting from the surface thereof adjacent its distal end.

A side receptacle 20 is disposed on each side face 21 of the body. Each side receptacle 20 takes the form of a rectangular slot extending vertically along a side face 21 and is defined by an end wall 34, opposed side walls 36 and open upper and lower ends. End wall 34 is substantially flat, while slot side walls 36 are contoured, having an outer lip 38, a center ridge 40, and an inner ridge 42 extending vertically therealong and projecting slightly into the slot. Inner ridge 42 and center ridge 40 define therebetween an inner groove 44 adjacent end wall 34. Center ridge 40 and outer lip 38 define therebetween an outer groove 46 adjacent side face 21. Inner grooves 44 and outer grooves 46 each have a smooth, concave inner profile. As best seen in FIG. 2, outer grooves 46 are wider and have a curvature of greater radius than inner grooves 44.

In the preferred embodiment, the width of slots 20 is substantially equal to the thickness of body 12, the thickness being the dimension as measured between top face 16 and bottom face 22.

Block 10 is preferably formed of thermoplastic material by a conventionally-known injection molding process, and may be of any size considered to be desirable for a toy building block. FIG. 2 shows a molding core 33 formed in each end peg 18 and in the underside of top peg 14, and are to aid in the injection molding process as is well known in the injection molding art.

The relative shapes and sizes of pegs 14, 18 and receptacles 20, 30 are such that any one of the nine receptacles may snugly receive any one of the three pegs of a similar block, and accordingly a plurality of blocks substantially similar to block 10 may be interlocked with one another in many different relative orientations, some of which are shown in FIGS. 3–9.

Figure 3:
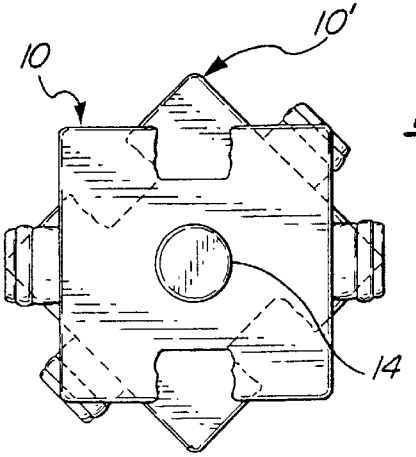
FIG. 3 is a plan view of a pair of the invention building blocks interconnected in a top-to-bottom manner.

FIG. 3 shows two identical blocks 10 and 10' interlocked in a top-to-bottom manner, top peg 14 being inserted into the central bottom receptacle of block 10'. Top peg 14 may alternatively be inserted into any of the other six bottom receptacles of block 10'. As depicted in FIG. 3, while blocks 10 and 10' are so interlocked, they may be rotated with respect to each other about the axis of top peg 14.

Figure 4:
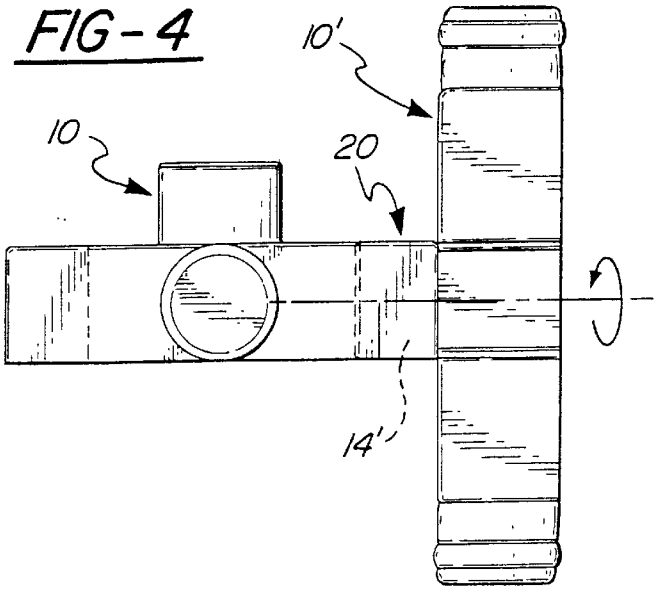
FIG. 4 is an elevation view of a pair of the invention building blocks interconnected in a top-to-side manner.

As depicted in FIG. 4, blocks 10 and 10' may also be interlocked in a top-to-side manner by inserting top peg 14' into a side receptacle 20 of block 10. In this interlocked orientation, the blocks may also be rotated with respect to one another about the axis of top peg 14'. It should be noted that the slot shape of side receptacle 20 permits this orientation may be achieved by sliding top peg 14' into the side receptacle from either the top or bottom end of the slot, as well as by urging the peg along its axis, straight into the slot in a horizontal direction.

Figure 5:
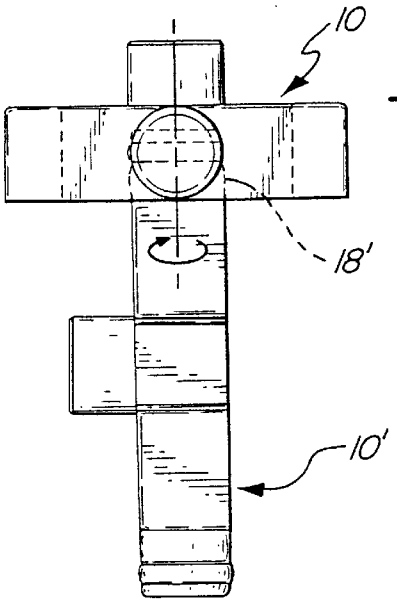
FIG. 5 is an elevation view of a pair of the invention building blocks interconnected in an end-to-bottom manner.

As depicted in FIG. 5, blocks 10 and 10' may also be interlocked in an end-to-bottom manner by inserting an end peg 18' into any one of the seven bottom receptacles 30 of block 10. In this interlocked orientation, block 10' may be rotated about the axis of end peg 18'.

Figure 6:
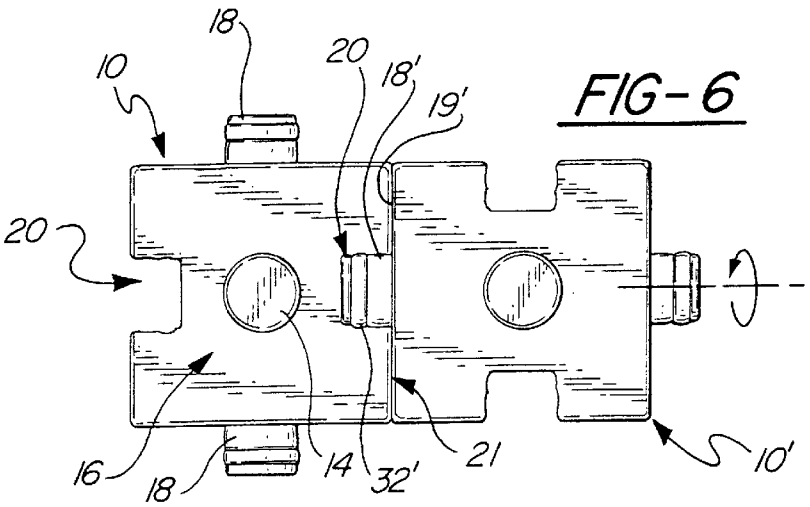
FIG. 6 is a plan view of a pair of the invention building blocks interconnected in an end-to-side manner, the blocks in a non-swivelling position.

FIG. 6 depicts blocks 10 and 10' interlocked in an end-to-side orientation. End peg 18' is inserted fully into side receptacle 20 such that bead 32' snaps into engagement with the inner groove of side receptacle 20 and end face 19' is touching or closely proximate to side face 21. Note that in this interlocked orientation, block 10' may be rotated with respect to block 10 about the axis of end peg 18'. The end-to-side interlocking engagement between blocks 10 and 10' shown in FIG. 6 may also be achieved either by urging end peg 18' axially into side receptacle 20, or by sliding the end peg into the side receptacle in a direction perpendicular to top face 16 of block 10.

Figure 7:
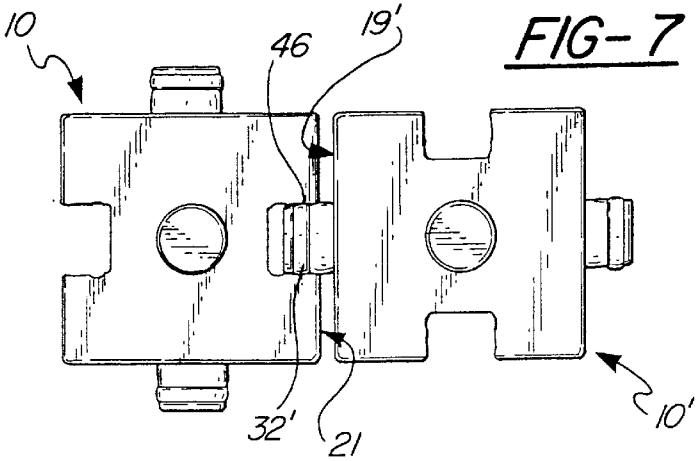
FIG. 7 is a plan view of a pair of the invention building blocks interconnected in an end-to-side manner, the blocks in a swivellable position.

FIG. 7 depicts blocks 10 and 10' in a swivellable end-to-side interlocked relationship. End peg 18' is inserted into side receptacle 20 a distance sufficient to place bead 32' of the end peg in engagement with outer groove 46 of the side receptacle of mating block 10. End face 19' of block 10' and side face 21 of block 10 are parallel but separated by a small distance. Relative rotation between the two blocks about the axis of end peg 18' is possible as described above in reference to FIG. 6.

Figure 8:
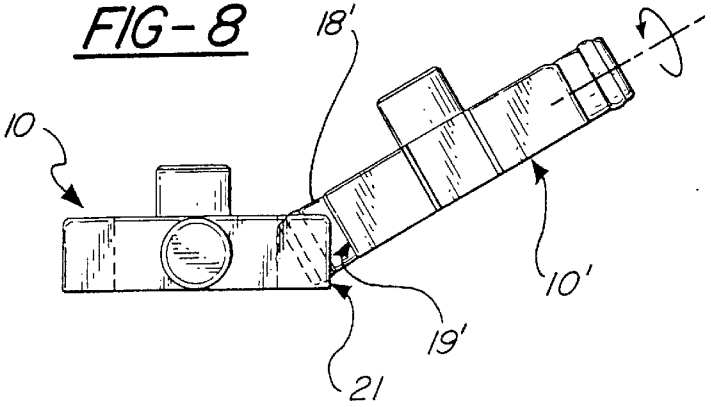
FIG. 8 is an elevation view of the building blocks of FIG. 7, the blocks hinged with respect to one another.

Engagement of bead 32' with the outer groove permits an additional degree of relative movement between the two blocks, as illustrated in FIG. 8. The spacing between side face 21 and adjacent end face 19' is sufficient to allow blocks 10 and 10' to swivel with respect to one another in a plane orthogonal to the planes of faces 19' and 20. The engagement between bead 32' and outer groove 46 permits a relative swivelling movement of the two blocks about an axis passing through the diametrically opposite points on bead 32' which contact outer groove 46.

The concave inner surfaces of outer grooves 46 are wider and have a greater radius of curvature than the convex profile of bead 32'. This greater radius allows sufficient clearance to permit relative swivelling movement of blocks 10 and 10'. Blocks 10 and 10' may be hinged through a full 180° with respect to each other. As a result of the end peg being in the form of a solid of revolution, such as a cylinder, the swivelling movement is possible even if blocks 10 and 10' are rotated with respect to one another about the axis of end peg 18'.

As is apparent from FIGS. 3–9, the invention block may be interlocked in a variety of different manners, and so provides the user a great many options when building a structure. The provision of discrete inner and outer grooves within the side receptacles provides for two alternative mating relationships between blocks when an end peg is inserted into a side receptacle, one swivelling and the other non-swivelling. This is a valuable feature because it permits a standard building block to be used for both swivelling and non-swivelling conditions, so that it is not necessary for a set of blocks to include a different, specialized block to provide the swivelling function.

The two-position, swivelling/non-swivelling feature of the present invention may also be achieved by peg and receptacle geometries other than exactly like that depicted herein. For example, two circumferential grooves could be formed on a cylindrical peg and a raised bead could be formed on each of the side walls of the receptacle. Engagement of the bead with the groove nearest the distal end of the peg would permit swivelling movement, while engagement of the bead with the groove nearer the root of the peg would inhibit swivelling. A number of other ways to achieve this result will be apparent to one of skill in the art.

Figure 9B:
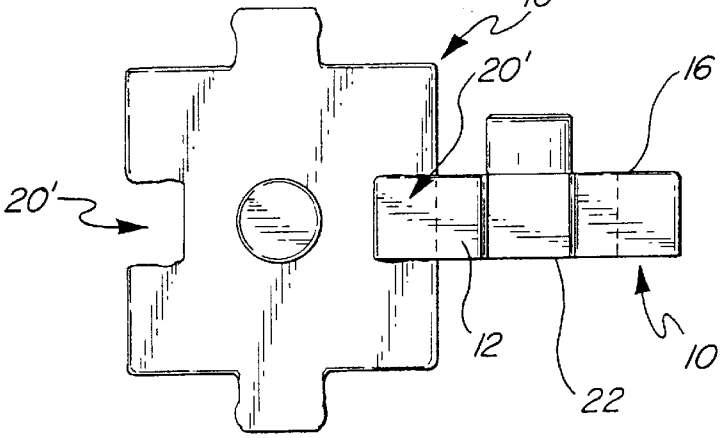
FIG. 9 is a pair of views showing a pair of the invention building blocks interconnected in a side-to-side manner, the body of one block inserted into the slot of the other.
Figure 9A:
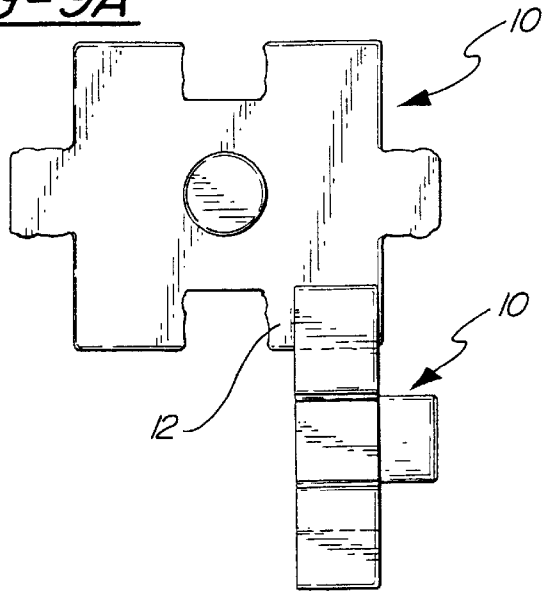

Another possible interlocking configuration is depicted in FIG. 9, which shows identical blocks 10 and 10' rotated 90° with respect to one another, and the body 12 of block 10 inserted into the slot 20' of block 10'. This configuration is possible because the width of slot 20' is substantially equal to the thickness of body 12, as measured between top face 16 and bottom face 22, so that the body of a block may be held securely in the slot of a mating block.

FIG. 10 depicts several examples of non-rectangular blocks useable for interlocking assembly with the rectangular block 10. All of the blocks have pegs and receptacles similar in geometry to those described hereinabove. Block 50 is circular in plan view and has four side receptacles, a top peg, and a bottom receptacle. Block 60 is in the form of a quarter-circle and has a side receptacle on one flat side and an end peg on the other flat side. Block 70 is in the shape of a right triangle and has a side receptacle on a first side and end pegs on a second side and on a hypotenuse. Block 80 is similar to block 70 except in having a side receptacle on the hypotenuse. Blocks 50, 60, 70, and 80 are merely a few examples of the various configurations of blocks which may be constructed in accordance with the present invention, many other configurations being possible.

Figure 12:
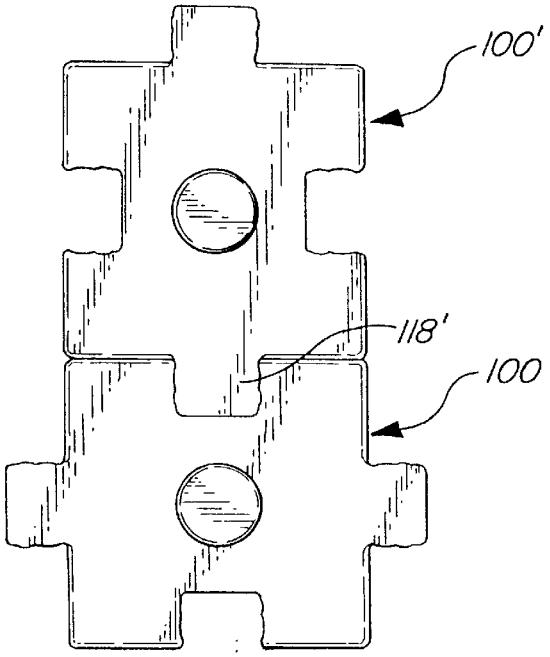
FIG. 12 is a plan view of two building blocks of the type shown in FIG. 10 connected in an end-to-side manner.
Figure 13:
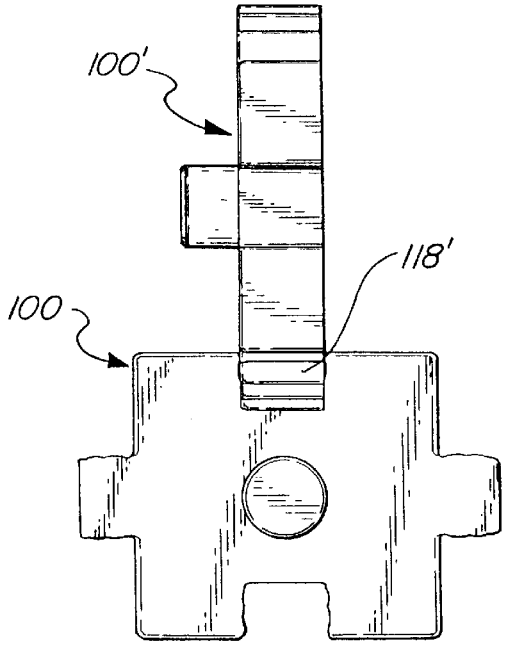
FIG. 13 is a view of the blocks of FIG. 11 in an alternative end-to-side manner.

FIGS. 11 through 13 depict a block 100 that differs in geometry from block 10 described hereinabove in that its end pegs 118 are generally rectangular in cross-section rather than being cylindrical. Each end peg 118 has a bead 132 extending vertically along either side thereof, the beads allowing the end pegs to be engaged with side receptacles 120 of similar blocks. Side receptacles 120 are substantially identical to the side receptacles 20 of the first described embodiment, each side wall being contoured to form an inner groove 144 and an outer groove 146.

Block 110, like block 10, is interlockable with similar blocks adjacent to any of its six faces and in the same variety of configurations depicted in FIGS. 3–9. The two-position interlockability of pegs 118 and side receptacles 120 allows blocks 110 to be swivelled out of plane in a manner similar to that illustrated in FIG. 8, or locked securely and non-swivelingly as shown in FIG. 12. Because of the rectangular shape of pegs 118, however, when two similar block 100 and 100' are interlocked in the end-to-side manner shown in FIG. 12 no rotation about the axis of end peg 118' is possible. The blocks may be interlocked in the 90° orientation shown in FIG. 13.

Although the lack of rotating movement about the axis of the rectangular peg 118 results in a slightly more limited number of different possible construction geometries than is possible with block 10, the structure resulting from use of block 110 is somewhat more rigid than with block 10. By producing blocks 10 and 110 which are identically shaped in all respects other than the configuration of side pegs 18, the two different embodiments are fully interchangeable with one another and may be combined in the same structure as desired.

Figure 14:
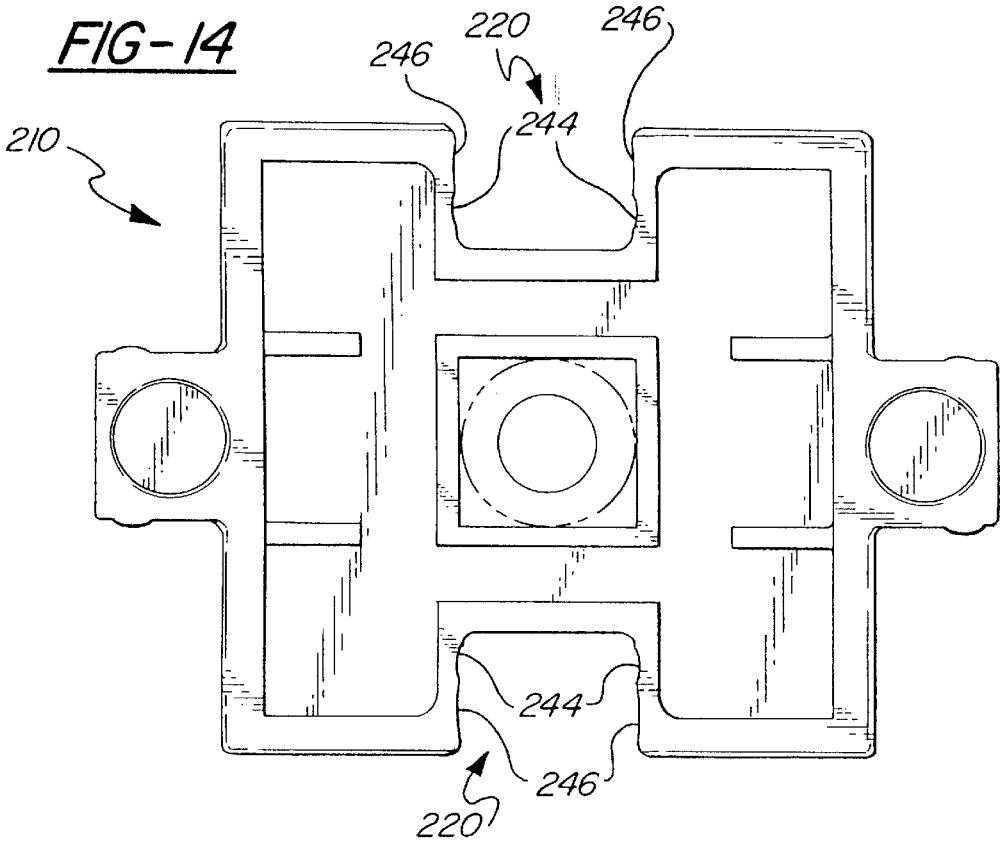
FIG. 14 is a bottom view of a third embodiment of the invention block.

FIG. 14 shows a block 210 having side receptacles 220 which are of a slightly different shape than those of blocks 10 and 110 described hereinabove. Side receptacles 220 have an inner groove 244 for securely retaining the bead of an end peg in a non-swivelling manner, and a very broad, large-radiused outer groove 246 for more loosely retaining the beads so as to increase the ease of swivelling movement. This configuration of outer groove 246 is well adapted for use with a block having rectangular end pegs.

Whereas a preferred embodiment of the invention has been illustrated and described in detail, it will be apparent that various changes may be made in the disclosed embodiment without departing from the scope or spirit of the invention.

The invention claimed is:

1. A toy building block comprising a body having parallel top and bottom faces and first and second substantially planar lateral faces orthogonal to the top and bottom faces, a lateral male feature projecting from the first lateral face and a lateral female feature recessed into the second lateral face, the lateral male and female features matingly engageable with female and male lateral features of other of said blocks to achieve interlocking connection of the block with said similar blocks, the block further characterized in that:

a top male feature projects from the top face and a bottom female feature is disposed on the bottom face, the bottom female feature being matingly engageable with top male features of other of said blocks, and the lateral male and female features have respective first and second interlocking means configured to engage with one another in a first mating position and in an alternative second mating position, the first mating position establishing a first connection between the blocks wherein the lateral male feature is inserted substantially fully into the lateral female feature such that adjacent faces of the connected blocks are parallel and proximate one another to inhibit swivelling movement of the connected blocks relative to one another in a plane orthogonal to the top and bottom faces, and the second mating position establishing a second connection between the blocks wherein the lateral male feature is inserted less than fully into the lateral female feature such that the adjacent faces of the connected blocks are separated from one another by a distance sufficient to permit said swivelling movement.

2. A toy building block according to claim 1 wherein the lateral male feature is a solid of revolution.

3. A toy building block according to claim 2 wherein the lateral male feature is substantially cylindrical.

4. A toy building block according to claim 2 wherein the first interlocking means comprises a protrusion extending substantially completely around the circumference of the lateral male feature.

5. A toy building block according to claim 1 wherein the lateral male feature is in the form of a substantially rectangular prism.

6. A toy building block according to claim 5 wherein the first interlocking means comprises a protrusion extending from at least a first side of the lateral male feature.

7. A toy building block according to claim 1 wherein the second interlocking means comprises spaced ridges on an interior surface of the lateral female feature defining therebetween a first groove engageable with the lateral male feature to establish the first mating position and a second groove engageable with the lateral male feature to establish the second mating position.

8. A toy building block according to claim 7 wherein the second groove is wider than the first groove.

9. A toy building block according to claim 1 wherein the lateral female feature is a substantially rectangular slot extending substantially completely along the second lateral face of the block.

10. A toy building block according to claim 1 wherein the body is in the shape of a generally rectangular prism and has a third lateral face parallel with the first lateral face and a fourth lateral face parallel with the second lateral face, the third lateral face having a second lateral male feature substantially identical to the lateral male feature and the fourth lateral face having a second lateral female feature substantially identical to the lateral female feature.

11. A toy building block according to claim 1 having a thickness measured between the top and bottom faces, and the lateral female feature being a substantially rectangular slot extending substantially completely along the second lateral face of the block between the top and bottom faces, the slot having a width substantially equal to thickness of the block.

12. A toy building block according to claim 1 having a plurality of bottom female features disposed on the bottom face, each of the bottom female features being matingly engageable with top male features of similar blocks and with lateral male features of similar blocks.

* * * * *